United States Patent [19]

Smithgall

[11] 4,050,763

[45] Sept. 27, 1977

[54] BASE AND SOCKET MEANS FOR AN ELECTRON TUBE

[75] Inventor: Harry E. Smithgall, Seneca Falls, N.Y.

[73] Assignee: GTE Sylvania Incorporated, Stamford, Conn.

[21] Appl. No.: 715,176

[22] Filed: Aug. 16, 1976

[51] Int. Cl.[2] ..... H01R 13/66

[52] U.S. Cl. ..... 339/111; 313/318; 339/143 T; 339/145 T; 339/193 VS

[58] Field of Search ..... 339/111, 143 R, 143 C, 339/143 T, 144 T, 145 T, 193 R, 193 VS, 193 N, 95 R; 313/318

[56] References Cited

U.S. PATENT DOCUMENTS

| | | | |
|---|---|---|---|
| 2,594,004 | 4/1952 | Farish | 339/143 R |
| 2,863,131 | 12/1958 | Carlzen | 339/143 T |
| 3,060,344 | 10/1962 | Scholes | 313/318 |
| 3,278,886 | 10/1966 | Blumenberg | 339/111 |
| 3,778,663 | 12/1973 | Beeson | 313/318 |
| 3,870,393 | 3/1975 | Hill | 313/318 |
| 3,979,157 | 9/1976 | DiMattio | 313/318 |

*Primary Examiner*—Roy Lake
*Assistant Examiner*—Mark S. Bicks
*Attorney, Agent, or Firm*—Norman J. O'Malley; Frederick H. Rinn; Robert T. Orner

[57] ABSTRACT

Electrical connective means are provided for effecting the external connections to a multi-element electron tube having a closure portion wherein the sealed exhaust tubulation has a conductive lead extending therefrom. The connective means includes a base member having a projecting hollow-stack portion which is formed to protectively encompass the sealed tubulation. Additionally, the hollow-stack has a metallic contact recessed therein, ahead of the seal, to which the protruding seal-related lead is affixed. A central recess is formed in a mating socket member to match the projecting stack of the base member. The stack is telescopically positioned within the recess to enable a receptor contact located therein to make seated abutment with the metallic contact in the base.

11 Claims, 6 Drawing Figures

BASE AND SOCKET MEANS FOR AN ELECTRON TUBE

CROSS REFERENCE TO RELATED APPLICATION

This application contains matter disclosed but not claimed in a related U.S. patent application filed concurrently herewith and assigned to the assignee of the present invention. This related application is Ser. No. 715,177.

BACKGROUND OF THE INVENTION

This invention relates to electrical connective means for effecting the external connection to an electron tube and more particularly to improved external electrical connective means for a multi-element electron tube having an isolated conductive lead extending from the closure portion thereof.

Many types of electron tubes, as for example, cathode ray tubes of the kind utilized in television and allied display applications, normally utilize a type of envelope closure having therein a protruding sealed exhaust tubulation surrounded by an array of substantially rigid supportive and connective leads or pins which traverse the closure and project exteriorly therefrom. Such closure constructions are usually capped by a suitable base member conventionally formed of plastic insulative material fabricated in a manner to provide a protective enclosure for the sealed tubulation, such being spatially surrounded by an array of perforations dimensioned to accommodate protrusion of the respective connective pins therethrough. Such construction effects protection for the sealed tubulation and the glass seals of the connective pins and provides strength to the protruding connective pins during insertion and removal from a compatible electrical socket means. Additionally, the base member usually incorporates a longitudinal alignment provision on the exterior of the tubulation-protection-portion to facilitate proper insertion of the respective pins into the recessed contacts of the matching tube socket. In those instances when a high voltage is directed from the electron gun assembly through one of the connective pins in the closure portion, arcing conditions sometimes develop due to the closeness of the pins in the connective array. Since arcing within the electron gun assembly, or between pins in the closure portion of the tube, may have catastrophic effects on components in the external circuitry, much effort has been directed to minimize the possibility of arching. Special efforts have been expended to insulate elements and connections within the electron gun structure in order to prevent the development of arcing conditions between adjacent elements of the tube. In addition, special insulative constructions have been incorporated into the base and socket members to minimize the possibility of arcing conditions, but in many instances, the resultant protective features produce results that are less than desired.

A successful approach to minimize arcing has been the development of a tube closure portion wherein a high voltage lead from the electron gun assembly is spatially and incorporated into the exhaust tubulation seal thereby effecting a discretely oriented electrical connection which is spatially isolated from the conventional array of connective pins.

OBJECTS AND SUMMARY OF THE INVENTION

It is an object of the invention to reduce and obviate the aforementioned disadvantages evidenced in the prior art. It is a prime object of the invention to provide electrical connective means for expeditiously effecting the external connections to a multi-element electron tube having a closure portion incorporating an array of exteriorly projecting conductor pins spatially surrounding an axially oriented protrusion of a sealed exhaust tubulation having a conductive lead extending therefrom. The connective means of the invention includes a protective base member wherein an axially oriented projecting hollow-stack portion, formed to protectively encompass the sealed exhaust tubulation, has a metallic contact recessed therein, at a location ahead of the tubulation seal, to which the axial conductive lead is affixed. In conjunction therewith, a mating socket member is fabricated to have a centrally related recess formed in the basal structure thereof to match the projecting stack portion of the base member, wherein the stack is telescopically positioned to enable a receptor contact, located within the recess, to make positive seated abutment with the metallic contact of the base member.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

Figure 1:
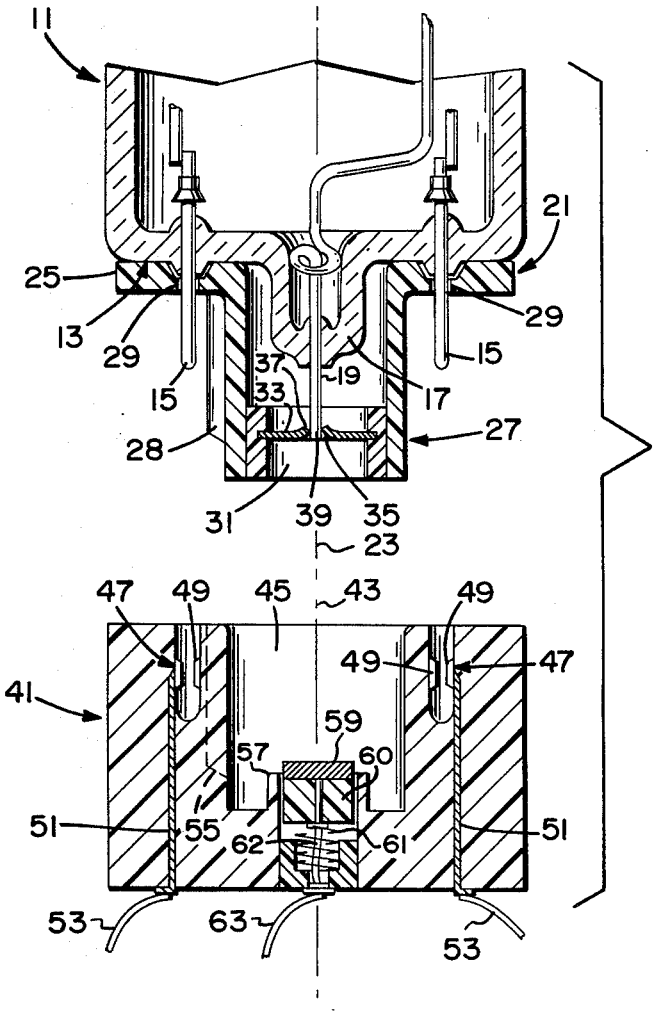
FIG. 1 is a composite sectional view illustrating related structures of the tube base and socket members.
Figure 2:
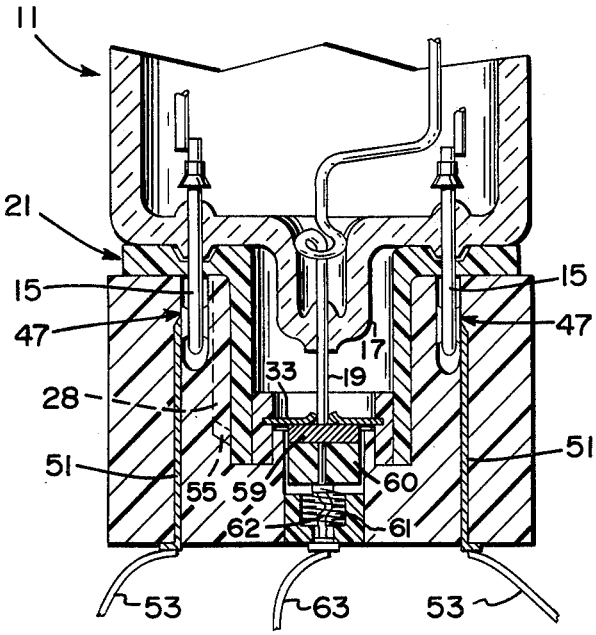
FIG. 2 is a cross-sectional view of the tube base and socket members in matched positioning.

With reference to FIGS. 1 and 2, there is shown electrical connective means for expeditiously affecting external connections for a multi-element electron tube 11, such as a cathode ray tube, having a closure portion 13 incorporating an array of exteriorly projecting electrical connections or conductor pins 15. These are spatially arrayed in a manner to surround an axially oriented protrusion of a sealed exhaust tubulation 17 having an axial conductive lead 19 extending therefrom.

A protective base member 21, formed of conventional insulative material, is fabricated for seating on the exterior surface of the closure portion of the tube. This base member has a longitudinal axis 23 therethrough about which a rim-like portion 25 surrounds an axially-oriented projecting hollow stack portion 27; this in turn is formed to protectively encompass the sealed exhaust tubulation 17 of the tube. The stack portion has a longitudinal alignment rib 28 formed exteriorly thereon. The rim-like portion 25 of the base member has a plurality of spatially related apertures 29 therethrough, these being oriented in a manner to match the array of conductor pins 15 projecting from the closure 13 of the tube, and dimensioned to receive and accommodate the protrusion of the respective pins therethrough. The hollow stack portion 27 of the base member has a terminal opening 31 permitting access to a metallic contact 33 recessed therein ahead of the sealed tubulation 17. As shown, this metallic contact element has a concavity 35 and a related aperture 37 formed therein wherein the terminal portion 39 of the axial conductive lead 19 extending from the tube is adequately bonded by means such as brazing or soldering.

The socket member 41 of the connective means is basically fabricated of insulative material formed to match the constructional features of the aforedescribed base member 21 to thereby effect the external electrical connections for the tube 11. The socket member has a longitudinal axis 43 therethrough and a centrally related recess 45 formed in the basal structure thereof, such being surrounded by plural arrangement of recessed electrical contacts 47 wherein the array of respective conductor pins 15 of the tube are positioned. The respective recessed contacts 47 have conventional resilient portions 49 and extending connective elements 51 for effecting separate external electrical connections 53 therefrom. The central recess 45 in the socket member is formed to match the projecting stack portion 27 of the base member to accommodate telescopic positioning of the stack therein, the alignment rib 28 in the stack portion mating with an alignment channel 55 in the socket member. Projecting into the central recess 45, from the bottom portion thereof, is a substantially centrally oriented protruding component 57 formed as an open-end cylinder wherein a receptor contact element 59 is resiliently loaded by spring-like means 61 in a manner to effect slidable, limited piston-like axial movement to the receptor contact which may have an insulative backing member 60, as shown. Upon inserting the base member 21 into the socket member 41, the metallic contact 33, recessed into the hollow stack of the base member 21, is directed to make positive seated abutment with the receptor contact 59 in the socket which has an internal conductor, such as resilient means 62, connected to an external connector 63 extending therefrom. As shown, the receptor contact projects beyond the terminal opening of the protruding component 57 to enable pressured abutment to be consummated.

Figure 3:
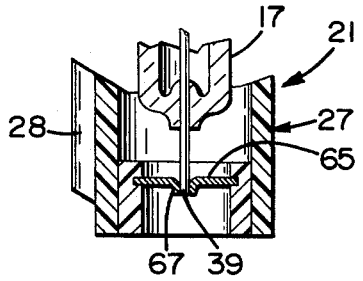
FIG. 3 is a partial cross-sectional view of the projecting hollow-stack portion of the base member illustrating one means for bonding of the axial lead with the metallic contact therein.
Figure 4:
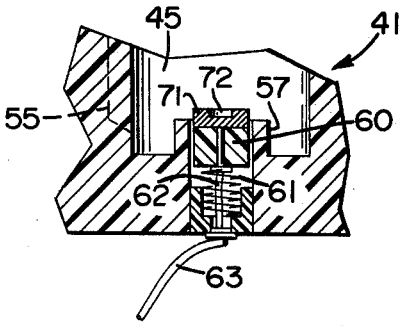
FIG. 4 is a partial cross-sectional view of the socket embodiment formed to mate with the base member illustrated in FIG. 3.

Another embodiment for effecting attachment of the axial conductive lead 19 of the electron tube with the recess-oriented metallic contact element 65 located within the hollow stack portion 27 of the base member, is shown in FIG. 3. In this instance the metallic contact 65 has a substantially axially oriented eyelet 67 formed therein in a manner to outstand therefrom. The terminal portion 39 of the axial conductive lead 19 is accommodated within this eyelet 67 and bonded therein by means such as brazing or welding. To accommodate this protruding eyelet-attachment-formation 67 of the metallic contact, a compatible modification has been incorporated into the receptor contact 71 of the socket member, as shown in FIG. 4. This modification is formed as a matching hollow 72 recessed in the receptor contact to receive and accommodate the eyelet formation 67 outstanding from the base-oriented contact 65. The mating of these compatible elements consummates seated abutment of the respective contacts and insures a positive pressured connection between the two.

Figure 5A:
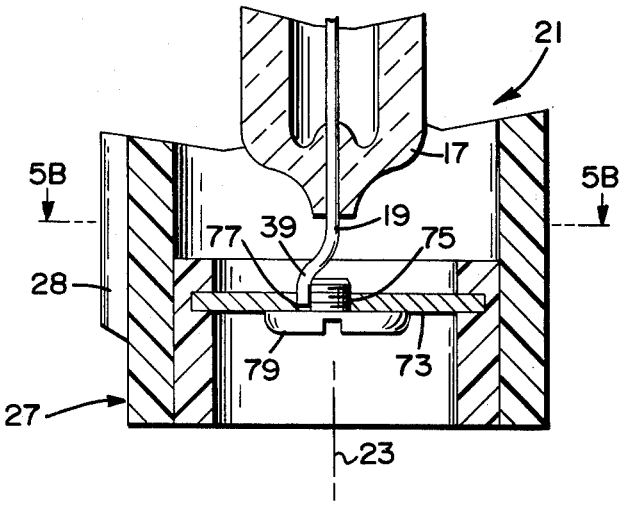
FIG. 5A is a partially sectioned view of another embodiment of the means for attaching the axial connector lead with the contact element in the socket member.
Figure 5B:
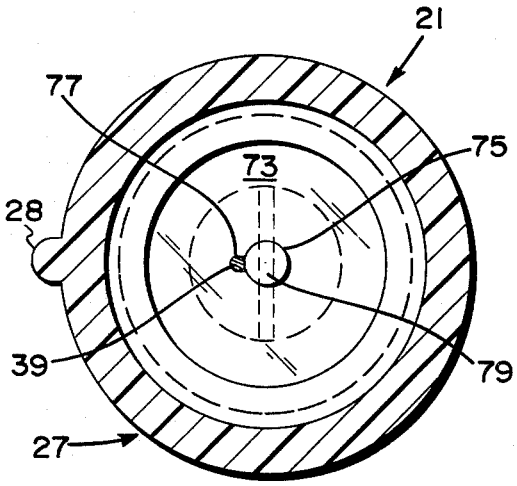
FIG. 5B is a plan view thereof taken through the line *5b–5b* of FIG. 5.

Another embodiment for effecting attachment of the terminal portion 39 of the axial conductive lead 19 of the tube to the metallic contact 73 of the base member 21 is shown in FIGS. 5A and 5B. In this embodiment the base-oriented metallic contact 73 is fabricated to have a threaded aperture 74 therein. Additionally, the threaded sidewall has a longitudinal niche 77 formed therein in a manner substantially parallel with the axis 43 of the base member. The terminal portion of the axial conductive lead 39 is positioned within this niche. Upon insertion of a contact screw member 79 into the threaded aperture 75, the conductive lead is pressured into the niche and is affixed therein as the screw member is seated against the metallic contact 73.

Thus, there is provided an expeditious connective means for efficiently connecting an axially oriented conductive lead of an electron tube to external circuitry. Matching base and socket members of the invention provide connective means wherein a high voltage lead is expeditiously accommodated to insure a maximum of isolation from related conductors.

While there has been shown and described what are at present considered the preferred embodiment of the invention, it will be obvious to those skilled in the art that various changes and modifications may be made therein without departing from the scope of the invention as defined by the appended claims.

What is claimed is:

1. A protective and connective base for a multi-element electron tube having a closure portion incorporating an array of exteriorly projecting conductor pins spatially surrounding an axially oriented protrusion of a sealed exhaust tubulation having an axial conductive lead extending therefrom, said base comprising:

an insulative member formed for seating on the surface of said closure, said base member having a longitudinal axis about which a rim-like portion surrounds an axially-oriented projecting substantially hollow stack portion formed to protectively encompass said sealed tubulation, said rim-like portion having a plurality of spatially related apertures therein substantially matching said array of conductor pins and dimensioned to promote adherence thereto, said hollow stack having a terminal opening and a metallic contact recessed therein, said contact formed to accommodate attachment of said axial conductive lead thereto.

2. The base member for a multi-element electron tube according to claim 1 wherein said metallic contact is made to have a concavity with related aperture therein formed to accommodate the attachment of said axial conductive lead therein.

3. The base member for a multi-element electron tube according to claim 1 wherein said metallic contact is fabricated to have a substantially axially oriented eyelet outstanding therefrom formed to receive said axial conductive lead for bonding thereto.

4. The base member for a multi-element electron tube according to claim 1 wherein said metallic contact is fabricated to have a threaded aperture therein, said threaded sidewall containing a longitudinal niche substantially parallel with said axis, said niche being dimensioned to accept the terminal portion of said lead, said base includes a contact screw member to be inserted into said threaded aperture.

5. Electrical connective means for effecting the external connections to a multi-element electron tube having a closure portion incorporating an array of exteriorly projecting conductor pins spatially surrounding an axially oriented protrusion of a sealed exhaust tubulation having an axial conductive lead extending therefrom, said connective means comprising:

a protective base formed as an insulative member for seating on the exterior surface of said closure, said base having a longitudinal axis about which a rim-like portion surrounds an axially oriented projecting hollow stack portion formed to protectively encompass said sealed tubulation, said rim-like portion having a plurality of spatially related apertures therein substantially matching said array of conductor pins and dimensioned to accommodate the protrusion of said pins therethrough, said hollow stack having a terminal opening permitting access to a metallic contact recessed therein at a location ahead of said tubulation seal, said axial conductive lead being affixed to said contact; and a socket formed as an insulative member to match said base member thereby effecting the external electrical connections for said tube, said socket member having an axis and a centrally related recess formed in the basal structure thereof surrounded by an arrangement of recessed contacts wherein said conductor pins are positioned, said central recess being formed to match the projecting stack portion of said base member wherein said stack is telescopically positioned, said recess having an externally connected centrally protruding component wherein a receptor contact is positioned to project therefrom, said component being inserted into the terminal opening in said stack in a manner to make positive seated abutment of said receptor contact with said metallic contact encompassed therein.

6. The electrical connective means for effecting the external connections to a multi-element electron tube according to claim 5 wherein said socket-oriented receptor contact is resiliently-loaded to effect pressured contact with said base-oriented metallic contact when the two are in abutment.

7. The electrical connective means for effecting the external connections to a multi-element electron tube according to claim 6 wherein the central protruding component is formed as an open-end cylinder permitting limited piston-like axial movement of said resiliently-loaded receptor contact therein.

8. The electrical connective means for effecting the external connections to a multi-element electron tube according to claim 5 wherein said base-oriented metallic contact is formed to have a concavity with a related therein wherein the terminal portion of said axial conductive lead is bonded.

9. The electrical connective means for effecting the external connections to a multi-element electron tube according to claim 5 wherein said base-oriented metallic contact is formed to have a substantially axially oriented eyelet outstanding therefrom wherein said axial conductive lead is accommodated and bonded.

10. The electrical connective means for effecting the external connections to a multi-element electron tube according to claim 9 wherein said socket-oriented receptor contact is formed to have a hollow therein to accommodate the eyelet formation outstanding from said base-oriented metallic contact to consummate seated abutment of said contacts.

11. The electrical connective means for effecting the external connections to a multi-element electron tube according to claim 5 wherein said base-oriented metallic contact is fabricated to have a threaded aperture therein, the threaded-sidewall of which contains a longitudinal niche substantially parallel with said axis wherein the terminal portion of said axial conductive lead is positioned by a contact screw member inserted and seated in said aperture.

* * * * *

UNITED STATES PATENT AND TRADEMARK OFFICE

CERTIFICATE OF CORRECTION

PATENT NO. : 4,050,763

DATED : September 27, 1977

INVENTOR(S) : Harry E. Smithgall

It is certified that error appears in the above-identified patent and that said Letters Patent are hereby corrected as shown below:

Col. 1, line 51 - Please delete "arching" and insert -- arcing --.

Col. 1, line 65 - After "spatially" and before "and" please insert -- positioned --.

Col. 6, lines 14 and 15 - After "related" and before "therein", please insert -- aperture --.

Col. 6, line 37 - After "positioned" and before "by", please insert -- and pressured --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*